United States Patent [19]

Miyamoto

[11] 4,301,572

[45] Nov. 24, 1981

[54] COMBING ROLLER

[75] Inventor: Noriaki Miyamoto, Kariya, Japan

[73] Assignee: Kabushiki Kaisha Toyoda Jidoshokki Seisakusho, Aichi, Japan

[21] Appl. No.: 107,072

[22] Filed: Dec. 26, 1979

[30] Foreign Application Priority Data

Nov. 20, 1979 [JP] Japan ..... 54-160588[U]

[51] Int. Cl.[3] ..... D01G 15/14

[52] U.S. Cl. ..... 19/97; 19/112

[58] Field of Search ..... 19/97, 112; 57/58.91, 57/58.95; 29/121.1, 127

*Primary Examiner*—Louis Rimrodt

*Attorney, Agent, or Firm*—Burgess, Ryan and Wayne

[57] ABSTRACT

In an improved combing roller provided with a metallic wire mounted on a body thereof comprising a main cylindrical body and a pair of flanges coaxially formed at both ends of the main cylindrical body, a base portion of the metallic wire rigidly pressed into a right hand or a left hand helical groove formed in the main body and the working direction of the metallic wire coincide with the rotational direction of the combing roller, at a terminal portion of the metallic wire facing one of the flanges on a side of the combing roller corresponding to the direction of progress of an imaginary right hand screw imaginarily engaged with the above-mentioned right hand helical groove or an imaginary left hand screw imaginary engaged with the above-mentioned left hand helical groove when the imaginary screws are turned in the direction corresponding to the rotational direction of the combing roller, at least one tooth is inclined toward the above-mentioned flange.

6 Claims, 9 Drawing Figures

COMBING ROLLER

SUMMARY OF THE INVENTION

The present invention relates to a combing roller utilized for an open-end spinning machine and, more particularly, relates to an improved combing roller wherein the roller is provided with a metallic wire mounted on the peripheral surface thereof without a free space where fibers can not receive effective combing action.

BACKGROUND OF THE INVENTION

In a known embodiment of the open-end spinning machine, a bundle of fibers supplied from an upstream supplying mechanism is opened by means of a combing roller, so as to separate the bundle into individual fibers, and the separated fibers are carried into a twisting mechanism so as to form a twisted yarn. In such an open-end machine, a combing roller provided with a metallic wire helically secured on the peripheral surface of the main body of the combing roller is utilized.

It is well known that the above mentioned metallic wire is provided with a cross-section comprising a laterally expanded base portion and a teeth portion projected upward from the base portion. When the metallic wire is mounted on the peripheral surface of the main body of the combing roller, the base portion of the metallic wire is pressed into a helical groove formed on the peripheral portion of the main body of the combing roller by means of a press roller, so that the metallic wire can be rigidly mounted on the main body of the combing roller. To attain an effective action of the combing roller, the helical groove is formed on the peripheral portion of the main body with a pertinent pitch along the axial direction of the combing roller. It is well known that the main body is coaxially provided with a flange at each end thereof. Therefore, in such a combing roller, cylindrical spaces are formed on the peripheral portion of the main body between the two flanges and the corresponding spiral portions of the metallic wire, which are the starting and terminal portions of the metallic wire. The axial size of those cylindrical spaces has been allowed to be almost the same as the above-mentioned pitch of the helical groove, that is the axial pitch of the metallic wire. It is the understanding of the inventors of the present invention that the reasons for the above-mentioned axial size of those cylindrical spaces are as follows. First since the mounting of the metallic wire on the main body of the combing roller is carried out by pressing the shoulder of the base portion of the metallic wire into the helical groove of the main body by means of a pressing disc having a certain thickness, it is necessary to have a space for carrying out the pressing operation when the pressing operation is carried out on the portions of the wire closest to the above-mentioned flanges, and; second, it is not recognized that the cylindrical spaces at the two end portions of the main body of the combing roller give rise to a serious problem.

According to the technical principle of the open-end spinning method, it is essential to feed well separated individual fibers into a yarn forming mechanism, such as a spinning rotor, and the function of the combing roller is to do this. Therefore, generally speaking, the body of the combing roller and the metallic wire are made with precision, and the mounting of the metallic wire on the main body of the combing roller is carried out with precision, so as to ensure the function of the combing roller. However, it is the experience of the inventors of the present invention that, even if the combing roller is made with precision as mentioned above, it is quite difficult to eliminate possible creation of slubby portions in the twisted yarn, and it is their understanding that one reason for the creation of such slubby portions is due to the defective functioning of the conventional combing roller which results from the above mentioned cylindrical spaces.

Therefore, the principal object of the present invention is to provide an improved combing roller which does not give rise to the above mentioned defective function of the conventional combing roller.

To attain the purpose of the present invention, an analysis of the action of the conventional combing roller was carefully carried out, and it was found that the above-mentioned cylindrical spaces formed at both of the axial end portions of the main body of the combing roller and free from the combing action even though a part of a supplied handle of individual fibers is introduced therein. Consequently, it is possible for blocks of entangled fibers to be fed into the yarn forming mechanism, such as the spinning rotor. The above-mentioned cylindrical spaces are hereinafter referred to as free spaces. Based on the above-mentioned result, the inventors of the present invention have devised the following described combing roller to attain the purpose of the present invention. That is, in the combing roller, if the rotation of the combing roller is counter-clockwise and a right hand helical groove for receiving the base portion of the metallic wire is formed on the cylindrical surface of the main body, and the base portion of the metallic wire is rigidly inserted into the above-mentioned helical groove in such condition that the working surface of each tooth of the metallic wire faces the direction of the combing roller, the teeth of a terminal portion of the metallic wire adjacent to the flange at the end of the roller corresponding to the direction of progress of an imaginary right hand screw turned in the counter-clockwise direction when in imaginary screw engagement with the right hand helical groove are bent toward the above-mentioned flange, so that the axial size of the free space between the above-mentioned flange and the above-mentioned terminal portion can be reduced remarkably from that of the known combing roller; while if the combing roller is turned counter-clockwise direction and the metallic wire is rigidly mounted into a left hand helical groove, and the working surface of each tooth of the metallic wire faces the rotational direction of the combing roller, the teeth of a terminal portion of the metallic wire adjacent to the flange at the end of the roller corresponding to the direction of progress of an imaginary left hand screw turned in the counter-clockwise direction when in imaginary engagement with the left hand helical groove, are bent toward the above mentioned flange, so that the axial size of the free space between said flange and said terminal portion can be reduced remarkably from that of the known combing roller. Utilizing the above described construction, the possible creation of the slubby yarn observed with the conventional combing roller can be effectively prevented. For the sake of simplifying the explanation presented hereinafter, the above-mentioned reduced free cylindrical; space is hereinafter referred to as a first free space, while the other free cylindrical space formed at a position between the other terminal portion of the metallic wire and the other flange is hereinafter referred to a second free space. Therefore, in the combing roller according to the present invention, the axial size of the first free cylindrical space is smaller than the second free space.

DETAILED EXPLANATION OF THE PRESENT INVENTION

Figure 1:
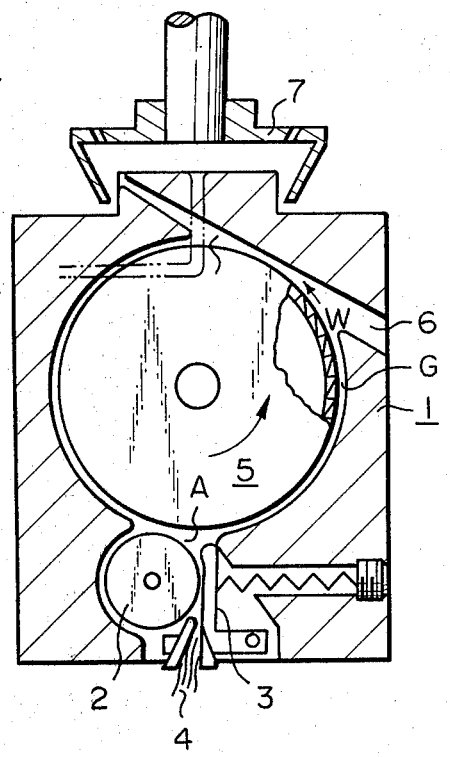
Fig. 1 PRIOR ART
FIG. 1 is a schematic side view, partly in section of the known open-end spinning unit.

Before explaining the preferred embodiments of the present invention, for the sake of a clearer understanding the present invention, the structure of the conventional combing roller and the defect thereof will first be explained in detail, with reference to the attached drawings of FIGS. 1, 2, 3, 4, 5, 6, 7, 8 and 9. It is possible to manufacture the following four types of combing rollers.

(1) In the case of mounting a metallic wire 8 on a main body 5*a* provided with a right hand helical groove 9 in such condition that the working surface of each tooth faces toward the counter-clockwise rotational direction of the combing roller 5:

(a) the shoulder side of the metallic wire 8 faces the direction of progress of an imaginary right hand screw in the helical groove 9 in an imaginary screw engagement when the imaginary right hand screw is turned in the counter clockwise direction;

(b) the shoulder side of the metallic wire 8 faces the direction opposite to the direction of progress of the imaginary right hand screw mentioned in 1(a), above.

(2) In the case of mounting a metallic wire 8 on the main body 5*a* provided with a left hand helical groove 9 in such condition that the working surface of each tooth faces toward the counter-clockwise rotational direction of the combing roller 5:

(a) the shoulder side of the metallic wire 8 faces the direction of progress of an imaginary left hand screw in the helical groove 9 in an imaginary screw engagement when the imaginary left hand screw is turned to the clockwise direction;

(b) the shoulder side of the metallic wire 8 faces the direction opposite to the direction of progress of the imaginary left hand screw mentioned in 2(a), above.

It is well known that when the metallic wire 8 is pressed into the helical groove 9, the base portion 8*a* of the metallic wire 8 is continuously pressed into the helical groove 9 toward the working direction W (in FIG. 1) of the metallic wire 8. However, to prevent any possible damage to the working face and point of each tooth of the metallic wire 8, and also, to prevent any possible damage to the helical groove 9, in the mounting operation of the metallic wire on the main body 5*a* of the combing roller, only the two conditions (1)-(a) and (2)-(b) mentioned above can be practically applied. That is, the combing rollers 5 having the construction illustrated in FIGS. 2 and 4, and FIGS. 3 and 5 are utilized at present.

Figure 2:
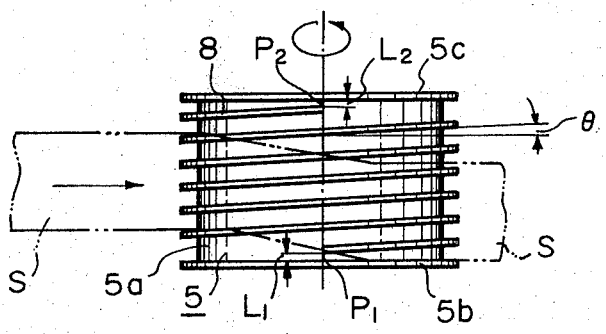
Fig. 2 PRIOR ART
FIG. 2 is a schematic front view of a combing roller utilized for the open-end spinning unit illustrated in FIG. 1, wherein the combing roller is provided with a metallic wire rigidly inserted into a right hand helical groove of formed on the main body thereof.
Figure 4:
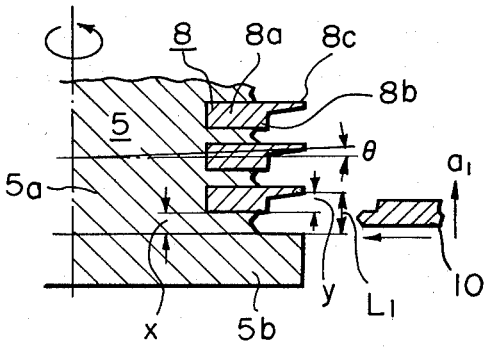
Fig. 4 PRIOR ART
FIG. 4 is a schematic sectional view of an end portion of the combing roller illustrated in FIG. 2, wherein a metallic wire is mounted in the known condition.

In the case of utilizing the combing roller 5 illustrated in FIGS. 2 and 4, when a sliver S is fed to the combing roller 5, since the combing roller 5, provided with a metallic wire 8 mounted thereon in a right hand helical groove, is rotated counter-clockwise, there is a tendency of displacing the fibers toward the direction of progress of an imaginary right hand screw turned counter-clockwise when in imaginary engagement with the helical groove 9. Such displacement tendency of the bundle of fibers S is represented by a two dot broken line in FIG. 2. It is understood that, according to the above-mentioned displacement, a plurality of fibers are introduced into the free space, that is the first free space, between a flange 5*b* located on the end of the roller corresponding to the above-mentioned direction of progress of the imaginary right hand screw turned counter-clockwise in imaginary engagement with the helical groove 9 and the adjacent terminal of the metallic wire 8. On the other hand, there is a tendency not to supply fibers into the second free space between the other flange and the end of the metallic wire 8 adjacent thereto. It must be recognized that the fibers introduced into the working zone of the combing roller 5 receive desirable opening action by imparting the combing action of the teeth of the metallic wire 8. However, in the above-mentioned first free space, since there are no teeth of the metallic wire on the peripheral surface of the main body 5, it is impossible to apply any combing action of the teeth of the metallic wire 8 to the fibers introduced therein and, consequently, such non-opened fibers are introduced into the yarn forming mechanism so that slubby portions are created in the yarn. Accordingly, it is the concept of the present inventors that, if the above-mentioned first free space is restricted so that it is as small as possible, the problem due to the possible creation of slubby portion of yarn, and possible breakage of yarn during the spinning operation can be eliminated. On the other hand, the axial size of the above-mentioned second free space is not serious, because of the tendency of fibers not to be introduced into this second free space and, therefore, it is essential to satisfy the condition that, the second free space be larger than the first free space.

In FIG. 4, indicating the conventional combing roller 5, the helical angle of the right hand groove is represented by $\theta$. The conventional process of mounting the metallic wire 8 on the main body 5*a* of the combing roller 5 by utilizing a pressing disc 10 is hereinafter explained, with reference to FIGS. 2 and 4. That is, a starting end of the metallic wire 8 having a cross section as shown in FIG. 4 is firstly pressed into a starting point $P_1$. The base portion 8*a* of the metallic wire 8 is continuously pressed into the helical groove 9 by pressing the shoulder 8*b* of the metallic wire 8, by means of a pressing disc 10 which is in rotatable contact with the shoulder 8*b*, toward the working direction W (FIG. 1) of the metallic wire and into the helical groove 9. In the above-mentioned operation, the pressing roller 10 is displaced toward a direction $a_1$, which is parallel to the axial direction of the body of the combing roller 5, since the pressing roller 10 is displacably mounted on a shaft (not shown) which is parallel to the axial direction of the body of the combing roller 5. As is well known, the metallic wire 8 is continuously supplied from a supply roll of the metallic wire (not shown). In such a mounting operation, since the pressing disc 10 is always located at a position separated from any portion of the helical groove 9 into which the metallic wire 8 has not been pressed, there is no possibility of damaging the helical groove 9 before the base portion 8*b* of the metallic wire is pressed into the groove 9. It must be further recognized that since the helical groove 9 is formed in the condition of right hand thread, when the base portion 8*b* of the metallic wire 8 is pressed into the helical groove 9, the teeth portion 8*c* of the metallic wire 8 has a tendency to slightly incline toward the axial direction opposite to the flange 5*b*, and there is no possibility of damaging the teeth portion 8*c* of the metallic wire 8 by its coming into contact with the pressing disc 10. It should be noted that it is possible to carry out the above mentioned mounting operation without damaging the groove 9 or teeth portion 8*c* because a wire 8 having the cross section illustrated in FIG. 4 is utilized in the conventional combing roller 5 illustrated in FIGS. 2 and 4.

Referring to FIGS. 2 and 4, the distance from the starting end of the helical groove 9, containing the metallic wire 8, to the flange 5*b* is represented by x, while the width of the shoulder 8*b*, which is almost equal to the distance from the tip of the teeth 8*c* to the shoulder side of the metallic wire 8, is represented by y. In the conventional combing roller, in order to accomodate the pressing disk 10, the axial size $L_1$ of the first free space is a sum of x and y.

Figure 3:
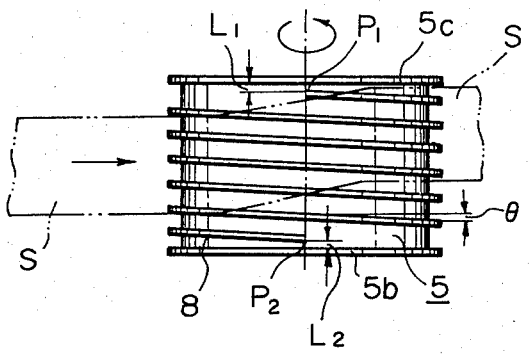
Fig. 3 PRIOR ART
FIG. 3 is a schematic front view of a combing roller utilized for the open-end spinning unit illustrated in FIG. 1, wherein the combing roller is provided with a metallic wire rigidly inserted into a left hand helical groove formed on the main body thereof.
Figure 5:
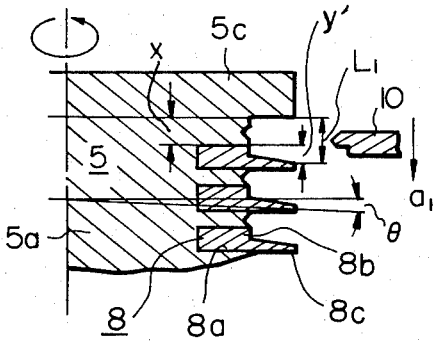
Fig. 5 PRIOR ART
FIG. 5 is a schematic sectional view of an end portion of the combing roller illustrated in FIG. 3, wherein a metallic wire is mounted in the known condition.

In the case of the conventional combing roller 5 illustrated in FIGS. 3 and 5, a similar condition to the above-described combing roller 5 illustrated in FIGS. 2 and 4 can be observed, except that in the case of FIGS. 3 and 5 the base portion 8*a* of the metallic wire 8 is pressed into the left hand helical groove 9 formed in the main body 5*a* of the combing roller 5. Therefore, elements having the same functions as those of the combing roller 5 illustrated in FIGS. 2 and 4 are represented by identical reference numerals, and the explanation thereof is omitted here.

The construction and function of the improved combing roller according to the present invention will now be explained in detail.

It will be understood from the above explanation that, in the conventional combing roller, it is normal to have such a construction that the axial size of the first free space is larger than the second free space, because the axial size of the first free space is a sum of x and y, while the axial size of the second free cylindrical space is x.

The problem to be solved by the present invention, then, is how to restrict the axial size of the first cylindrical spaces.

After careful study of the construction and function of the combing roller, it was concluded that if the points of the teeth, at least the point of the tooth, located at an end portion of the metallic wire, adjacent to the flange of the first free cylindrical space, are bent toward that flange, the axial size of the first free space can be effectively reduced, so that the problem of nep production with in the conventional combing roller can be effectively eliminated. It is this concept which formed the logical basis for the present invention.

The construction and function of the improved combing roller according to the present invention will now be explained in detail.

Figure 6:
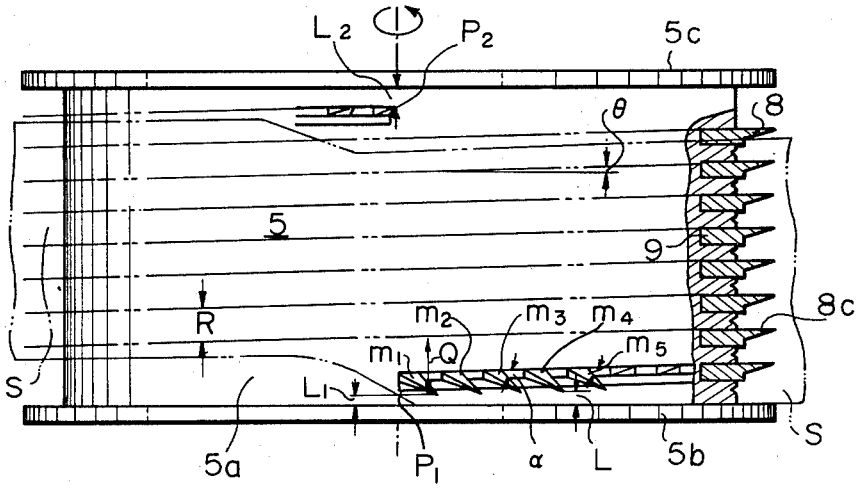
FIG. 6 is a schematic front view, partly in section, of an embodiment of the combing roller according to the present invention.

Referring to FIG. 6, wherein the metallic wire 8 is rigidly inserted into a right hand helical groove 9, the shoulder side of the metallic wire 8 faces the flange 5*b* located on the end of the roller corresponding to the direction of progress of an imaginary right hand screw turned in the clockwise direction when in imaginary screw engagement with the groove 9. In this case the working surface of teeth of the metallic wire coincide with the rotational direction of the combing roller 5 which rotates in the counter-clockwise direction as illustrated in FIG. 6.

Therefore, as already discussed, when a bundle of fibers S is supplied to the combing roller 5 while the combing roller 5 is rotating in the counter-clockwise direction, the bundle of fibers S is displaced toward the side of the flange 5*b*, while being carried in the rotational direction of the combing roller 5. Such phenomenon is represented by two dot broken line in FIG. 6. Therefore, if a conventional combing roller is utilized, in the first free space formed between the flange 5*b* and the terminal portion of the metallic wire 8 adjacent to the flange 5*b*, a group of fibers introduced into this free space can not receive any combing action by the metallic wire 5. However, in the combing roller 5 of the present invention illustrated in FIG. 6, five teeth, $m_1$, $m_2$, $m_3$, $m_4$ and $m_5$, of the terminal portion of the metallic wire 8, that is, the five teeth from the first tooth $m_1$ at the starting point $P_1$ to the fifth tooth $m_5$ from the tooth $m_1$, are bent toward the flange 5*b*. The bending angle of those teeth, $m_1$, $m_2$, $m_3$, $m_4$ and $m_5$, is represented by $\alpha$ in FIG. 6. Therefore, the axial size $L_1$ of the first free space is reduced by providing such bent teeth in the terminal portion of the metallic wire 8. Since the metallic wire 8 is rigidly mounted in the right hand helical groove 9, the distance L between the tip of the bent teeth ($m_1$, $m_2$, $m_3$, $m_4$ and $m_5$) and the flange 5*b* is gradually increased as illustrated in FIG. 6. However, since the combing roller 5 rotates in the counter-clockwise direction in this drawing, even if only the above-mentioned terminal tooth $m_1$ is bent, the group of fibers introduced into this first free space can receive the opening action of this tooth $m_1$, so that the problem regarding neps when utilizing the conventional combing roller can be eliminated. Since in this embodiment, the five teeth, $m_1$, $m_2$, $m_3$, $m_4$ and $m_5$, are bent toward the flange 5*b*, the group of fibers introduced into the first free space receive the effective action of those teeth. As illustrated in FIG. 6, because the teeth $m_1$, $m_2$, $m_3$, $m_4$ and $m_5$ are bent toward the flange 5*b*, the axial distance Q between those teeth and the laterally adjacent teeth of the metallic wire 8 formed in the next helical portion of the helical groove 9 is enlarged from the normal pitch R of groove 9. However, since the metallic wire 8 is rigidly inserted into the helical groove 9, a group of fibers introduced into the space corresponding to the above-mentioned enlarged axial distance Q receives at least one action of one of the teeth formed on the metallic wire portion adjacent to the alignment of the teeth $m_1$, $m_2$, $m_3$, $m_4$ and $m_5$ when the combing roller 5 makes one rotation. It is known that the combing roller 5 rotates at a very high speed in comparison with the feeding speed of the silver S, for example, between 5000 and 10000 rpm, and therefore, in the practice, the group of fibers introduced into the above-mentioned space can receive sufficient opening action by the teeth formed on the metallic wire portion adjacent to the alignment of the teeth $m_1$, $m_2$, $m_3$, $m_4$ and $m_5$. Consequently, it is clear that the above-mentioned formation of the bent tooth or teeth in the terminal portions of the metallic wire adjacent to the flange 5*b* is an excellent solution to elimination of the problem concerning generation of slubby portions of yarn with the conventional combing roller.

To carry out the above-mentioned construction of the combing roller 5, a tool of special design is utilized to bend the tooth portion 8*c* of the teeth of the terminal portion metallic wire. The operation of bending the tooth portion 8*c* is carried out after rigidly mounting the metallic wire in the helical groove 9.

Regarding the second free space between the flange 5*c* and the terminal portion of the metallic wire 8 adjacent to the flange 5*c*, the axial distance $L_2$ is not of serious concern regarding the possible creation of slubby yarn. However, the teeth of this terminal portion may be bent toward the flange 5*c*, even though there is only a very small probability of introducing fibers into this second free space.

In the above-mentioned embodiment illustrated in FIG. 6, five teeth $m_1$, $m_2$, $m_3$, $m_4$ and $m_5$ are bent toward the flange 5*b*. However, according to the experience of the present inventors, the number of such bent teeth may be changed. For example, in the case of spinning a yarn of synthetic fibers having a thickness courser than the thickness of cotton fiber, at least 9 teeth from the tooth formed at the starting terminal of the metallic wire 5 may be bent toward the flange 5*b*, and if necessary, such number of teeth bent toward the flange 5*b* may be increased to 20. It is also applicable to non-successively bend a tooth or some teeth toward the flange 5*b* in the terminal portion of the metallic wire 5 to attain the purpose of the present invention. In the embodiment illustrated in FIG. 7, seven successive teeth, $m_1$, $m_2$, $m_3$, $m_4$, $m_5$, $m_6$ and $m_7$, in the starting portion of the metallic wire 8 are bent toward the flange 5*b*. In this embodiment the bending angles $\alpha$ of those teeth toward the flange 5*b* are gradually reduced to zero, for example the bending angle $\alpha_2$ of the tooth $m_2$ is larger than the bending angle $\alpha_5$ of the tooth $m_5$.

Figure 7:
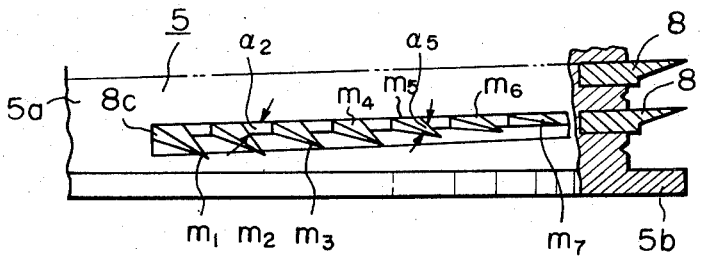
FIG. 7 is a schematic front view, partly in section, of a part of another embodiment of the combing roller according to the present invention.
Figure 8:
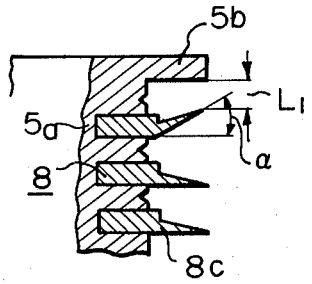
FIGS. 8 and 9 are cross-sectional views of a part of the combing roller according to the present invention.
Figure 9:
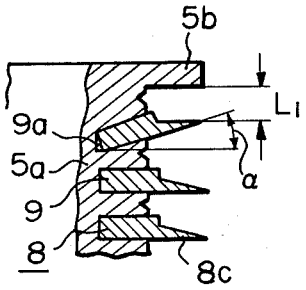

In the above-mentioned embodiments illustrated in FIGS. 6 and 7, the teeth 8*c* of the terminal portion of the metallic wire 5 adjacent to the flange 5*b* are bent toward the flange 5*b* so that the axial size of the first free space $L_1$ can be effectively reduced, as can be clearly understood from the drawing of FIG. 8. However, if the terminal portion of the metallic wire 8 is rigidly inserted into a portion 9*a* (FIG. 9) of the helical groove 9, wherein the groove of this portion 9*a* is formed with a certain angle corresponding to the bending angle $\alpha$ in FIG. 8 with respect to a plane perpendicular to the rotational axis of the combing roller 5, even if the tooth portion 8*c* of the metallic wire is not bent, a result similar to the embodiment illustrated in FIGS. 6, 7 and 8 can be created.

In the case of rigidly mounting the metallic wire 8 in a left hand helical groove 9 formed on the main body 5*a* on the combing roller 5, as illustrated in FIG. 3, a similar technical idea to the above-mentioned embodiments illustrated in FIGS. 6 and 7 is applied to the terminal portion of the metallic wire 8 adjacent to the flange 5*c* of the combing roller 5 which rotates in the clockwise direction, and a similar effect to that of the embodiments illustrated in FIGS. 6 and 7 can be created. Therefore, a detailed explanation thereof is omitted.

As mentioned above, it is clear that, if at least one tooth of the terminal portion of the metallic wire 5 adjacent the flange of the combing roller 5, located on the side of the roller to which supplied fibers are axially displaced during the rotation of the combing roller is directed toward that flange, the group of fibers introduced into the first free space formed between that flange and the adjacent portion of the metallic wire can be effectively opened by such that tooth or teeth of the metallic wire. As a result, the possible creation of slubby yarn and possible yarn breakage due to such creation of slubby yarn can be prevented.

What is claimed is:

1. An improved combing roller for an open-end spinning machine, wherein a metallic wire having teeth is mounted on a body of said combing roller, said body comprises a main cylindrical body and a pair of flanges coaxially formed at both ends of said main body, a base portion of said metallic wire is pressed into a right hand or left hand helical groove formed in said main body and the working direction of said metallic wire coincides with the rotational direction of said combing roller, said improvement comprising a terminal portion of said metallic wire facing one of said flanges on a side of the roller corresponding to the direction of progress of an imaginary right hand screw imaginarily engaged with said right hand helical groove or an imaginary left hand screw imaginarily engaged with said left hand helical groove when said imaginary screws are turned in the direction corresponding to the rotational direction of said combing roller, said terminal portion of said metallic wire provided with at least one tooth inclined toward said flange.

2. An improved combing roller according to claim 1, wherein said terminal portion of said metallic wire is provided with a plurality of teeth starting from said terminal end thereof which are inclined toward said flange.

3. An improved combing roller according to claim 2, wherein the angle of inclination of said teeth is constant.

4. An improved combing roller according to claim 2, wherein the angle of inclination of said teeth is gradually decreased from said tooth at said terminal end thereof toward said tooth at normal portion of said metallic wire successive to said terminal portion.

5. An improved combing roller according to claim 1, wherein said tooth inclination is created by bending said tooth toward said flange.

6. An improved combing roller according to claim 1, wherein said tooth inclination is created by rigidly inserting said base of said terminal portion of said metallic wire into a terminal portion of said helical groove formed with a certain angle with respect to a plane perpendicular to the rotational axis of said combing roller.

* * * * *